United States Patent [19]

Gasseling

[11] 4,330,948

[45] May 25, 1982

[54] METHOD AND APPARATUS FOR CONTROLLABLY BREAKING CAKED BED OF DRYING HOPS

[76] Inventor: Allen J. Gasseling, P.O. Box 2 Moxee City, Wash. 98936

[21] Appl. No.: 174,587

[22] Filed: Aug. 1, 1980

[51] Int. Cl.[3] ..... F26B 3/06

[52] U.S. Cl. ..... 34/181; 34/233; 34/236; 414/539

[58] Field of Search ..... 34/225, 233, 236, 181; 414/304, 539

[56] References Cited

U.S. PATENT DOCUMENTS

| | | | |
|---|---|---|---|
| 479,328 | 7/1892 | Jones | 414/539 |
| 1,554,378 | 9/1925 | Sinclair | 414/539 |
| 2,755,563 | 7/1956 | Cohen | 34/233 |
| 3,755,917 | 9/1973 | Lambert, Jr. | 34/233 |
| 3,829,986 | 8/1974 | Ruigrok et al. | 34/233 |

*Primary Examiner*—Larry I. Schwartz

*Attorney, Agent, or Firm*—Harvey B. Jacobson

[57] ABSTRACT

A plurality of elongated flexible members are initially disposed in generally parallel relation over a foraminous support structure upon which a bed of hops to be dried is subsequently placed and through which heated drying air is to be subsequently pumped for passage upwardly through and drying the bed of hops. After the bed of hops has been partially dried and the hops of the bed have settled and become crusted, opposite ends of adjacent elongated members are upwardly displaced from opposite sides of the bed of hops in order that the elongated members may tear upwardly through the crusted bed of hops in the manner of an elongated flexible tear member. After the bed of hops has been torn by the elongated members from opposite sides of the bed, heated drying air may continue to pass upwardly through the bed of hops for the purpose of completing the drying process.

12 Claims, 4 Drawing Figures

METHOD AND APPARATUS FOR CONTROLLABLY BREAKING CAKED BED OF DRYING HOPS

BACKGROUND OF THE INVENTION

Various structures heretofore have been provided for drying beds of hops. Conventionally, a plurality of closely spaced jsupport strips are erected in a horizontal plane and a loosely woven support panel is disposed over the strips for the purpose of supporting a bed of hops to be dried from the strips, heated drying air being pumped upwardly through the strips and the support panel for ultimate upward passage through the bed of hops in order to dry the same. However, as a bed of hops dried, the hops contract, compact and form a crust which blocks the passage of drying air upwardly through the bed. This blockage of drying air extends the necessary drying time, consumes greater amounts of fuel and requires the erection and use of additional drying buildings in order to enable all of a crop of hops to be harvested and dried within a given length of time. Accordingly, a need exists for a structure and method by which a partially dried and caked or crusted bed of hops may be broken up to enable continued passage of drying air therethrough. Conventionally, workmen walk on the partially dried bed of hops and jab pitchfork-like implements down into the bed, the tines of the implements including enlarged heads on the free ends thereof whereby they will not readily penetrate the loosely woven panel supporting the bed of hops and will break up the bed of hops as the tines are pulled upwardly therethrough. This, of course, subjects the workmen to extreme high temperatures and consumes considerable time.

In addition, various different types of driers including some provided with agitating structures are disclosed in U.S. Pat. Nos. 78,485, 277,876, 361,6422, 660,408 and 3,036,510.

BRIEF DESCRIPTION OF THE INVENTION

The apparatus for drying hops of the instant invention includes the usual "open" flooring having a loosely woven support panel disposed thereover upwardly through which heated drying air may pass. The support panel is adapted to receive a bed of hope thereon to be dried, but the apparatus includes a plurality of elongated, flexible and generally parallel members disposed upon the support panel at generally right angles to the strips of the "open" flooring and the bed of hops to be dried is placed over the loosely woven support panel and elongated members. After the bed of hops has been partially dried and has become compacted and crusted, alternating opposite ends of the elongated members are pulled upwardly resulting in alternate elongated members being torn through the crusted bed of hops in opposite directions in order to break up the crusted hops and to again enable full passage of drying air upwardly therethrough for completion of the drying process.

The main object of this invention is to provide a method and apparatus for facilitating the drying of a bed of hops.

Yet another object of this invention is to provide a method and apparatus in accordance with the preceding object and which will be effective to break up a caked bed of partially dried hops without workmen having to walk across the partially dried bed of hops.

Yet another important object of this invention is to provide a method and apparatus of facilitating the drying of a bed of hops and which will result in a reduction of drying time, a savings in fuel and a savings in work hours.

A further object of this invention is to provide a method and apparatus for facilitating the drying of hops which will allow a greater production of dried hops to be accomplished through the utilization of a given hops drying building.

A final object of this invention to be specifically enumerated herein is to provide a method and apparatus for more efficient drying hops and which will conform to conventional forms of manufacture, be of simple construction and easy to use and perform.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
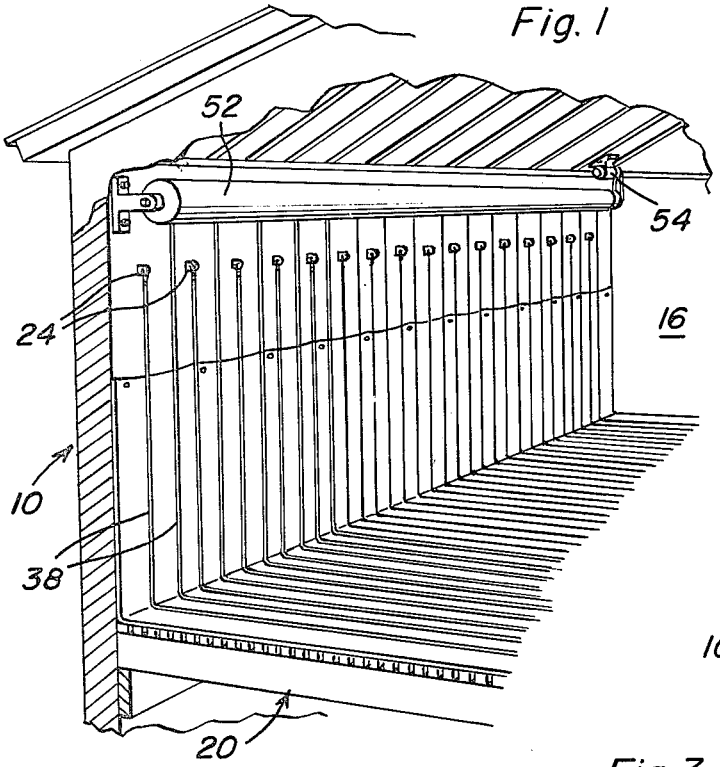
FIG. 1 is a fragmentary, perspective view of a portion of the interior of a building utilized for drying hops and incorporating the structure and method of the instant invention.

Referring now more specifically to the drawings, the numeral 10 generally designates a hops drying building including opposite side walls 12 and 14, opposite end walls 16 and a roof structure 18 closing the upper portion of the building 10. The building 10 includes an intermediate height "open floor" referred to in general by the reference numeral 20 and an open mesh support panel 22 is disposed over the floor 20 and includes marginal portions which extend upwardly along and are removably anchored relative to the opposite side walls 12 and 14 as at 24 and 26.

The flooring 20 includes a plurality of generally parallel stringers or joists 28 disposed in laterally spaced apart and generally parallel relation and extending between the side walls 12 and 14. Supportive side-by-side and laterally spaced apart slats 30 are secured over the stringers or joists 28 at generally right angles relative thereto and the support panel 22 overlies the slats 30.

Figure 2:
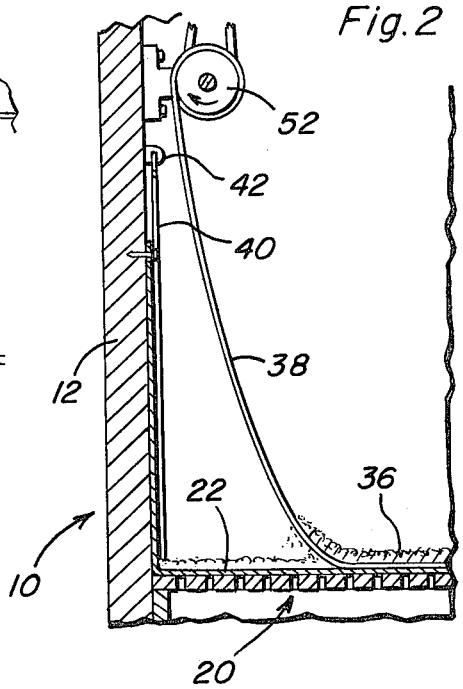
FIG. 2 is a fragmentary, vertical sectional view illustrating the manner in which the elongated flexible members underlying the bed of hops may be pulled upwardly in order to "tear" through a partially dried and caked bed of hops.
Figure 3:
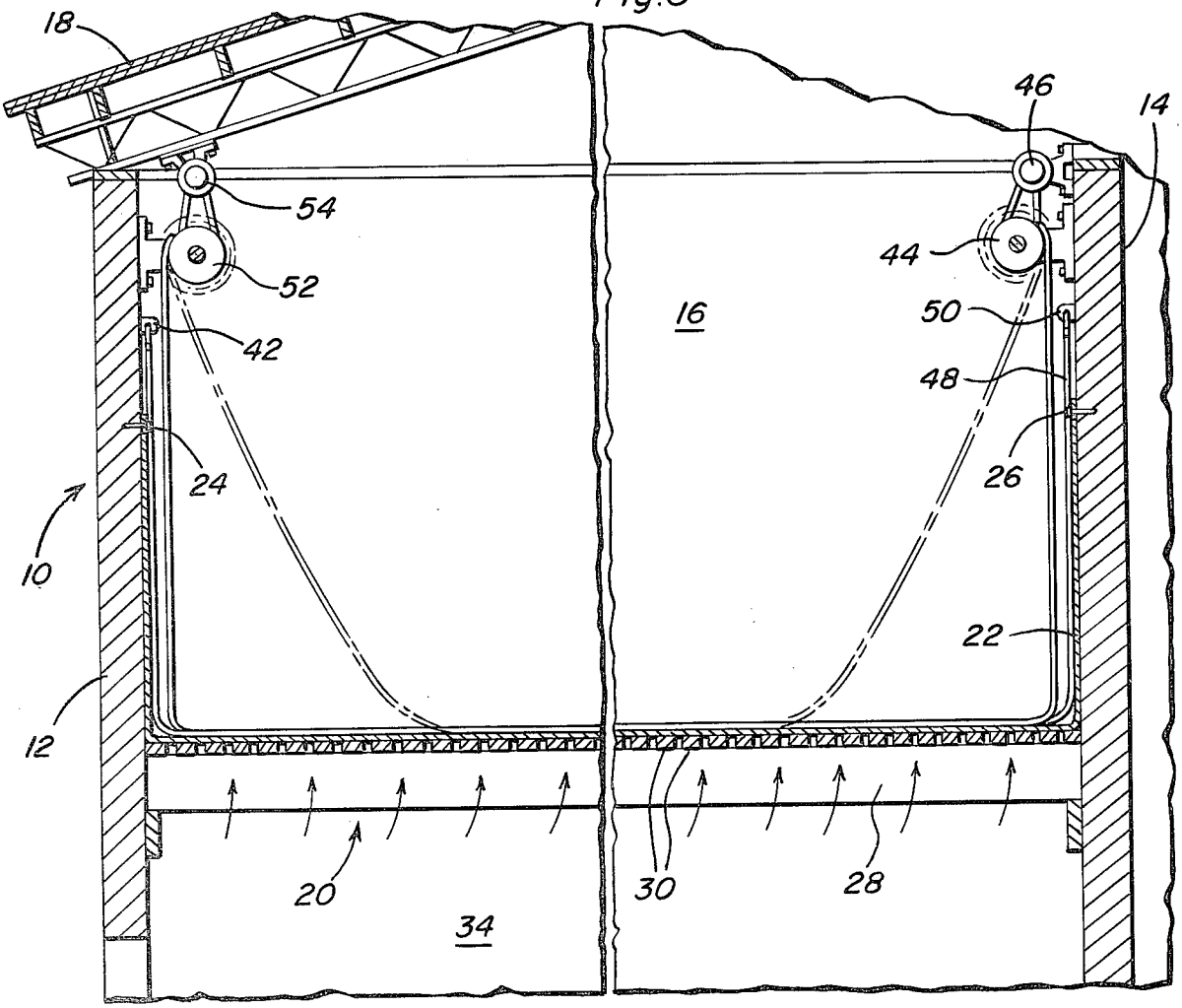
FIG. 3 is an enlarged, fragmentary, vertical sectional view illustrating the manner in which alternating elongated flexible members are upwardly displaced from opposite sides of the associated bed of hops.
Figure 4:
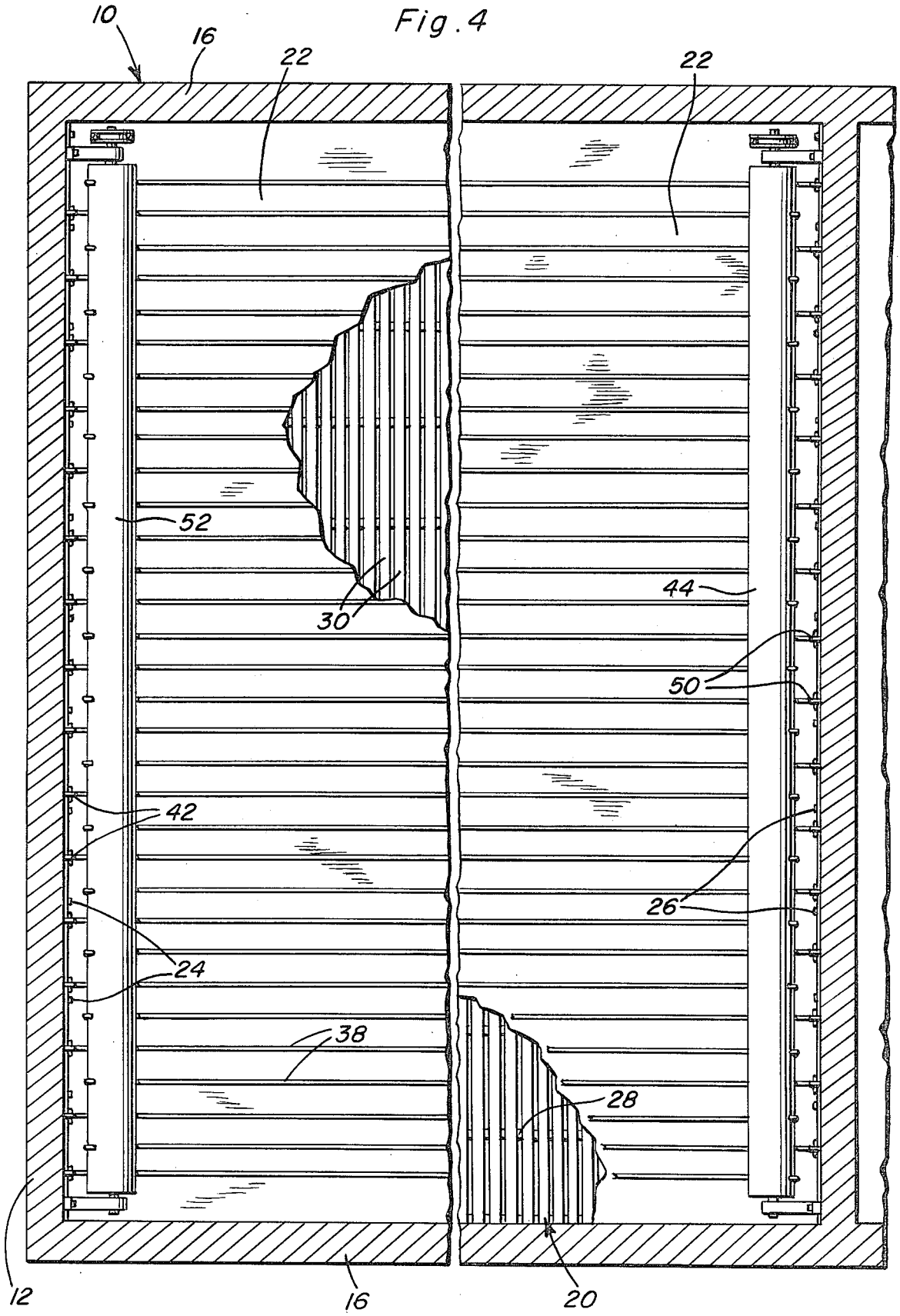
FIG. 4 is an enlarged, fragmentry, horizontal sectional view of the structure illustrated in FIG. 3.

The foregoing comprises a description of a conventional hops drying building, it being understood that heated drying air is pumped into the area 34 below the flooring 20 for passage upwardly between the stringers or joints 28 and the slats 30, upwardly through the support panel 22 and upwardly through a bed 36 (see FIG. 2) of hops disposed on the support panel 22.

The instant invention includes a plurality of elongated flexible members 38 which are disposed in overlying relation to the panel 22 prior to the disposition of the bed 36 of hops on the panel 22 and one set of alternate elongated members 38 has one set of corresponding ends 40 thereof anchored to the side wall 12 as at 42 while the other set of corresponding ends thereof are anchored relative to a rotary drum 44 journaled from and extending along the side wall 14 and driven by an electric variable speed and reversible motor 46. The other set of elongated members 38 has one set of ends 48 thereof anchored to the side wall 14 as at 50 and the other set of ends anchored relative to a rotary drum 52 journaled from and extending along the upper portion of the side wall 12 and driven by a reversible variable speed electric motor 54.

As the bed 36 of hops is initially dried by the heated air passing upwardly therethrough from the area 34, the hops contract, compact and become crusted. After the crust has been formed, further passage of heated drying air upwardly through the bed 36 is greatly reduced by the crusted portions of the bed 36 resulting in a considerable length of additional time required to complete the drying process.

Usually, it is at this time that one or more workmen must walk over the bed 36 and punch numerous holes through the bed 36 in order to again restore the upward passage of drying air therethrough. However, even this manner of perforating the crusted bed 36 does not restore full flow of drying air upwardly through the bed 36, unless a considerable amount of man work hours are consumed during the process of perforating the bed 36.

With the instant invention, once the bed 36 has become crusted to the extent that the upward flow of heated drying air therethrough is appreciably blocked, the motors 46 and 54 are actuated, either simultaneously or alternately, to effect an upward pull on the associated elongated member ends. This upward pull on the corresponding elongated member ends causes the associated elongated members to "tear" upwardly through the bed 36 in the manner illustrated in FIG. 2 of the drawings. By having alternate elongated members 38 pulled upwardly from opposite side walls 12 and 14, there is no tendency for the entire bed 36 to be lifted from one side by the elongated members 38. The spacing between adjacent elongated members 38 is approximately 12 inches and the bed of hops, when initially laid on the support panel 22, is approximately 36 inches deep. By pulling alternate elongated members 38 upwardly from opposite sides of the building 10, the caked and partially dried bed 36 is substantially completely broken up in order to restore the free upward passage of heated and drying air therethrough.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for drying hops including a generally horizontal support structure defining upstanding heated air passage extending therethrough, an open mesh panel overlying said support structure and adapted to have a bed of hops to be dried disposed thereon, and a plurality of generally parallel elongated members disposed on said panel and to be covered by said bed, raising means operatively connected to said elongated members for raising the latter relative to said panel subsequent to partial drying, and thus settling and crusting of said bed, for the purpose of upwardly displacing said elongated members through the settled and crusted partially dried bed of hops, said raising means including means operative to raise a first set of selected elongated members and thereafter raise a second set of selected elongated members through said bed without lifting said bed.

2. The combination of claim 1 wherein said elongated members are flexible and one end of each is stationarily mounted, said raising means being operatively connected to the other end of each elongated member.

3. The combination of claim 2 wherein said raising means includes means operative to individually raise sets of elongated members.

4. An apparatus for drying hops including a generally horizontal support structure defining upstanding heated air passages extending therethrough, an open mesh panel overlying said support structure and adapted to have a bed of hops to be dried disposed thereon, and a plurality of generally parallel elongated members disposed on said panel and to be covered by said bed, raising means operatively connected to said elongated members for raising the latter relative to said panel subsequent to partial drying, and thus settling and crusting, of said bed for the purpose of upwardly displacing said elongated members through the settled and crusted partially dried bed of hops, said elongated members being flexible and one end of each being stationarily mounted, said raising means being operatively connected to the other end of each elongated member, said raising means including means operative to individually raise sets of alternate elongated members, said other ends of the sets of elongated members being disposed at remote sides of said panel.

5. The combination of claim 4 wherein said other ends are elevated above and directed upwardly away from said remote sides of said panel.

6. The method of preparing for and accomplishing controlled breaking of a partially dried and crusted bed of hops, said method comprising laterally upwardly displacing a first set of elongated crust breaking members through said bed from the underside thereof and thereafter laterally upwardly displacing a second set of elongated members through said bed from the underside thereof, and with at least the portions of said crust breaking members passing through said bed being inclined relative thereto, whereby a progressive tearing action is effected on said bed by each set of said crust breaking member without lifting said bed.

7. The method of claim 6 wherein said crust breaking members comprise elongated members extending in generally parallel relation across the bottom of said bed.

8. The method of claim 7 wherein said crust breaking members are flexible and are upwardly displaced through said bed by elevating one end of each of said elongated members and thereby using each elongated member as a tear member.

9. The method of preparing for and accomplishing controlled breaking of a partially dried and crusted bed of hops, said method comprising upwardly displacing crust breaking members through said bed from the underside thereof, said crust breaking members comprising elongated members extending in generally parallel relation across the bottom of said bed, said crust breaking members being flexible and being upwardly displaced through said bed by elevating one end of each of said elongated members and thereby using each elongated member as a tear member, opposite end portions of laterally alternate elongated members being upwardly displaced through said bed.

10. The method of preparing for and accomplishing controlled breaking of a partially dried and crusted bed of hops disposed upon a foraminous support structure having drying air pumped upwardly therethrough, said method comprising placing a plurality of elongated, generally parallel flexible members on said support structure prior to the placement of said bed of hops on said support structure, and successively raising selected ends of a first set of said elongated flexible members upwardly through said bed and then selected ends of a second set of elongated members upwardly through said bed to cause the elongated flexible members to tear through said crusted bed along generally straight parallel paths without lifting said bed.

11. The method of claim 10 wherein the step of raising selected ends of said elongated flexible members includes raising the opposite ends of at least some adjacent elongated flexible members.

12. The method of preparing for and accomplishing controlled breaking of a partially dried and crusted bed of hops disposed upon a foraminous support structure having drying air pumped upwardly therethrough, said method comprising placing a plurality of elongated members on said support structure prior to the placement of said bed of hops on said support structure, and laterally raising selected ends of a first set of said elongated members upwardly through said bed to cause the first set of elongated members to tear through said bed and thereafter laterally raising selected ends of a second set of said elongated members upwardly through said bed to cause the second set of elongated members to tear through said bed, with said first and second sets of elongated members tearing through said bed along generally straight paths without lifting said bed after the latter has been at least partially dried.

* * * * *